US007992871B2

(12) United States Patent
Häusler

(10) Patent No.: US 7,992,871 B2
(45) Date of Patent: Aug. 9, 2011

(54) DEVICE FOR CHANGING THE DIRECTION OF MOVEMENT OF SHEET-TYPE PRODUCTS

(75) Inventor: August Häusler, Wolfratshausen (DE)

(73) Assignee: Giesecke & Devrient GmbH, Munich (DE)

( * ) Notice: Subject to any disclaimer, the term of this patent is extended or adjusted under 35 U.S.C. 154(b) by 350 days.

(21) Appl. No.: 11/922,327

(22) PCT Filed: Jun. 14, 2006

(86) PCT No.: PCT/EP2006/005751

§ 371 (c)(1),
(2), (4) Date: May 2, 2008

(87) PCT Pub. No.: WO2006/133935

PCT Pub. Date: Dec. 21, 2006

(65) Prior Publication Data

US 2009/0033019 A1 Feb. 5, 2009

(30) Foreign Application Priority Data

Jun. 15, 2005 (DE) ..... 10 2005 027 710

(51) Int. Cl.
*B65H 39/10* (2006.01)

(52) U.S. Cl. ..... 271/298; 271/184

(58) Field of Classification Search ..... 271/3.01, 271/225, 298, 184, 185
See application file for complete search history.

(56) References Cited

U.S. PATENT DOCUMENTS

| | | | | |
|---|---|---|---|---|
| 4,083,556 | A * | 4/1978 | Schilling et al. | 271/204 |
| 4,512,255 | A * | 4/1985 | Crist | 101/230 |
| 4,722,444 | A | 2/1988 | Murphy et al. | |
| 4,909,374 | A * | 3/1990 | Skrypalle | 198/371.3 |
| 4,913,295 | A * | 4/1990 | Murphy et al. | 209/583 |
| 6,098,978 | A | 8/2000 | Bielefeld et al. | |
| 6,659,258 | B2 * | 12/2003 | Otsuka | 194/206 |
| 2005/0029168 | A1 | 2/2005 | Jones et al. | |

FOREIGN PATENT DOCUMENTS

| | | |
|---|---|---|
| DE | 196 32 224 A1 | 2/1998 |
| GB | 2 073 153 A | 10/1981 |
| WO | WO 97/33823 | 9/1997 |

* cited by examiner

*Primary Examiner* — Michael C McCullough
(74) *Attorney, Agent, or Firm* — Bacon & Thomas, PLLC

(57) ABSTRACT

A transport apparatus for transporting flat, rectangular sheet material, in particular sheet-shaped value documents such as bank notes, comprises a distributing element reciprocating between at least two positions, or at least two distributing elements reciprocating between two positions, the distributing element or elements moving delivered sheets of the sheet material alternatively or alternatingly into at least two removal positions, and at least one removal device for carrying off the sheets out of the removal positions in removal directions associated with the removal positions.

64 Claims, 8 Drawing Sheets

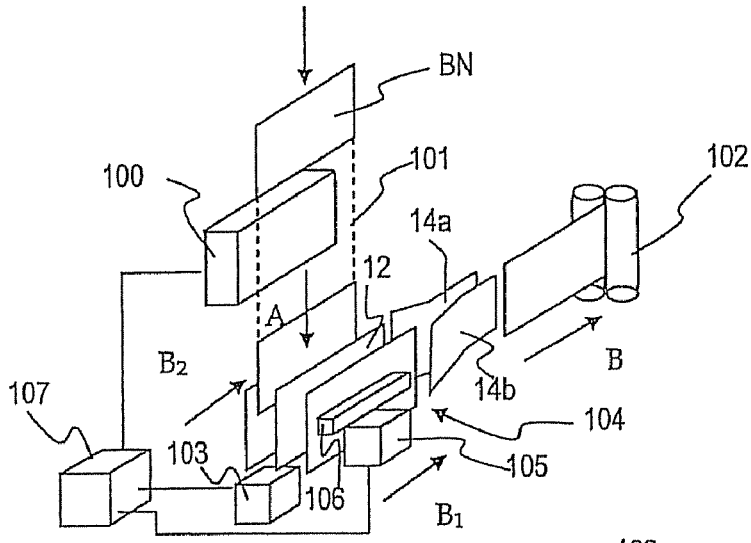
Fig. 7
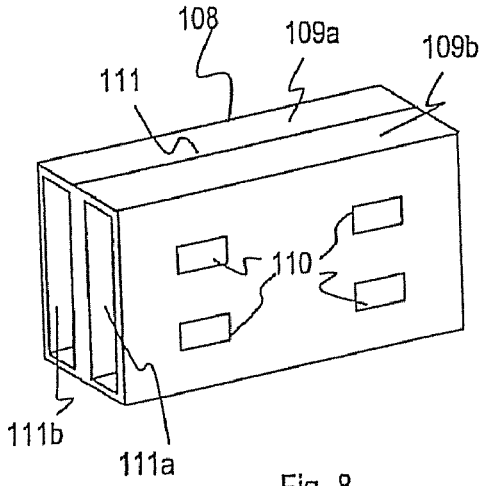
Fig. 8
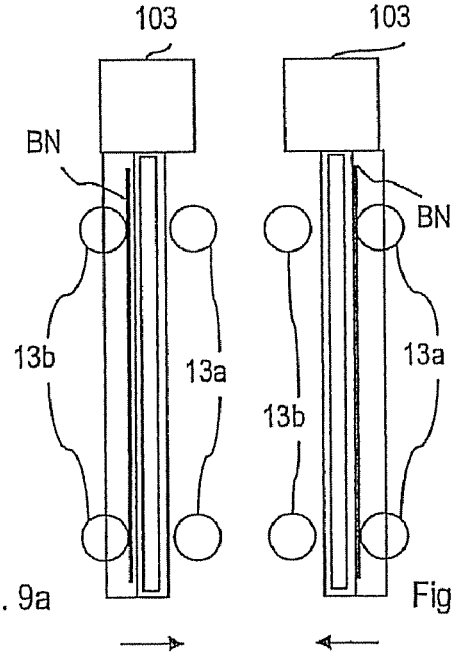
Fig. 9a
Fig. 9b
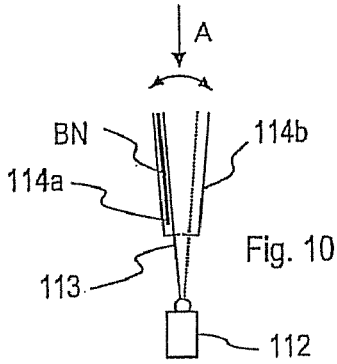
Fig. 10
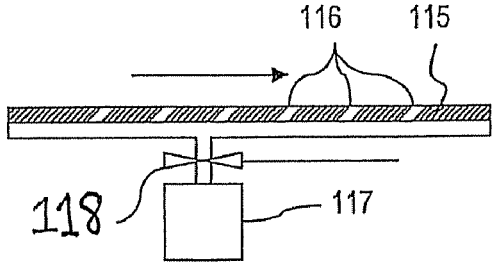
Fig. 11

DEVICE FOR CHANGING THE DIRECTION OF MOVEMENT OF SHEET-TYPE PRODUCTS

BACKGROUND

A. Field

This invention relates to a method and transport apparatus for transporting flat, rectangular sheet material, in particular sheet-shaped value documents such as bank notes, from a first sheet-material transport path to a second sheet-material transport path, in particular also for changing the transport direction by 90 degrees such that sheet material transported in transverse orientation is transported further in longitudinal orientation, or vice versa. The invention relates furthermore to an apparatus for processing sheet-shaped value documents, in particular bank notes, with such a transport apparatus between first and second transport paths.

B. Related Art

Sheet material is understood here to mean sheets having substantially a rectangular basic form, whereby the corners can be sharp or rounded. The invention can be used for any sheet material, but is in particular suitable for sheet material in the form of sheet-shaped value documents, for example vouchers, coupons, shares and in particular also bank notes.

Transport apparatuses by which sheet material is transferred from a transverse transport to a longitudinal transport, or vice versa, are used for example in bank-note processing apparatuses. Transverse or longitudinal transport is understood here to mean that the sheet material is transported in a transport direction in such a way that the longer side of the sheets is oriented transversely or parallel to the transport direction. Conventional diverting apparatuses, however, are either unsuitable for diverting an uninterrupted bank-note stream in such a way at high throughput speed or are at least comparatively troublesome with regard to space requirements and/or their structural layout.

US 2005/0029168 A1 discloses for example a multimodular bank-note processing apparatus in which the transport apparatus according to the invention described hereinafter is also usable advantageously. Said bank-note processing apparatus is configured as a tabletop device and serves to single the bank notes of a bank-note stack inserted into an input pocket by an operator, to check the singled bank notes with regard to characteristic features by means of suitable measuring and analysis devices, to sort the checked bank notes according to the particular check result, and to stack them in a predetermined output pocket by means of a spiral slot stacker depending on the sorting result. The output pockets are disposed partly side by side and partly one above the other such that all output pockets are optimally reachable by the operator. The bank notes are transported fundamentally in transverse orientation within the modules. However, according to one embodiment the bank notes can be fed in longitudinal orientation. In this case, the bank notes are briefly stopped after singling and then transported further to the right or to the left at right angles in the same plane. However, the mechanism for changing the transport direction of the fed bank notes by 90 degrees from the original longitudinal orientation to the required transverse orientation is not specified.

A disadvantage of said bank-note processing apparatus is that the transport of the bank notes from one module to an adjacent module is effected in transverse transport. The transport path is accordingly wide and space-consuming. This can have an adverse effect on the overall size of the total apparatus. Furthermore, the throughput rate of said bank-note processing apparatus is limited, because when the bank notes are fed in longitudinal orientation and passed on laterally in transverse orientation, the laterally passed-on bank notes must first have completely left the diverting area to avoid collision with the next bank note to be diverted. If the bank-note feed is effected in transverse format, in contrast, a very voluminous transport path formed from guide plates and twisted transport belts is provided in order to rotate the bank notes such that they can be transported further laterally in transverse orientation.

WO 97/33823 discloses an apparatus for changing the transport direction of single sheets as could presumably be used in the bank-note processing apparatus known from US 2005/0029168 A1 in order to divert the singled bank notes fed in longitudinal orientation to the right and to the left by 90 degrees so that they are transported further in transverse orientation. However, said apparatus has the above-mentioned disadvantage that the diverting area must first be cleared before the next bank note can enter the diverting area.

DE 196 32 224 A1 also describes an apparatus for changing the moving direction of sheet material. It is proposed therein to do without diverting rollers in the diverting area as are for example also present in WO 97/33823 A1, and instead extend the transport belts of the feeding and removing transport paths beyond the diverting zone in each case such that the bank note is removed from the diverting zone by means of the transport belt of the removing transport path. By means of a lever and roller system the transport belt of the removing transport path is urged against the removal plane of the diverting area whenever a bank note has been fed to the removal plane. To increase the throughput while avoiding the previously described risk of collision of consecutive bank notes, a special embodiment provides for supplying the consecutive bank notes by means of a gate alternatingly to a first or second removal plane so that the next sheet can already be fed to the second removal plane before the preceding sheet has been completely removed from the first removal plane and passed on. This accordingly requires two removal systems, one for each removal plane. Since two removal systems are provided on each side of the removal planes, i.e. altogether four removal planes, the bank notes can even be diverted in two opposite directions at high throughput. However, providing a plurality of removal systems requires high constructional effort.

SUMMARY

It is therefore the object of the present invention to propose a transport apparatus for transporting sheet material such as bank notes or other sheet-shaped value documents, and in particular for diverting the sheet material between a first sheet-material transport path and a second sheet-material transport path, which permits high throughput with relatively low constructional effort. The invention is further based on the problem of specifying a corresponding transport method.

The problem is thus solved by a transport apparatus for transporting flat, rectangular sheet material, in particular sheet-shaped value documents such as bank notes, having a distributing element reciprocating between at least two positions, or at least two distributing elements reciprocating between two positions, said distributing element or elements moving delivered sheets of the sheet material alternatively or alternatingly into at least two removal positions, and at least one removal device for carrying off the sheets out of the removal positions in removal directions associated with the removal positions.

The problem is in particular further solved by a method for transporting flat, rectangular sheet material, in particular sheet-shaped value documents such as bank notes, wherein sheets of the sheet material delivered in a feed direction in singled form are delivered in a feed direction, a distributing element or two distributing elements are reciprocated between at least two positions, said distributing element or elements moving the delivered sheets alternatively or alternatingly into one of at least two removal positions, and the sheets stopped in their motion in the feed direction are carried off out of the removal positions in carry-off directions or removal directions associated with the removal positions.

The transport can be effected in particular from a first sheet-material transport path defining the feed direction to at least a second sheet-material transport path. The term "removal"/"remove" is understood here to mean "carrying off", so that for example the removal direction is the carry-off direction.

The inventive transport apparatus also has two removal positions, for example removal planes, so that a sheet can be removed out of the first removal position, e.g. out of the first removal plane or from the first removal plane, while the next sheet is already being fed to the second removal position, e.g. the second removal plane. However, the sheet material is distributed over the at least two removal positions by means of the distributing element or distributing elements which upon motion into their positions move, in particular push, sheets of the sheet material into the removal positions, and for this purpose preferably come in contact with said sheets. The two distributing element positions or, if there are more than two positions, at least two of the positions correspond to a different removal position in each case. No further device for transporting sheets from a place where they are diverted alternatively or alternatingly out of a common feed plane for distribution over the removal positions is therefore required.

Therefore it is possible—but not necessary—to omit a gate for selective feed.

The method and the inventive transport apparatus can be preferably used when the transport directions of two adjacent sheet-material transport paths are different, in particular extend at an angle of 90 degrees to each other. In the method, at least one of the removal directions (B) and the feed direction are then different, it being particularly preferable for the removal direction (B) to extend at an angle of 90° to the feed direction. The apparatus is for this purpose preferably so configured that at least one of the removal directions and the feed direction are different, and particularly preferably that at least one of the removal directions extends at an angle of 90° to the feed direction.

The sheet material is preferably fed in transverse transport. The apparatus is for this purpose preferably so configured that the sheet is feedable to the apparatus and in particular to the removal positions in transverse transport. Transverse transport is understood here to mean that the rectangular sheet material which can also have rounded corners is transported with the longer side approximately transverse to the transport direction. The apparatus can then be in particular so configured that the sheet material is transportable after removal in longitudinal transport, i.e. with the longitudinal side at least approximately in the transport direction.

However, the apparatus is equally applicable for further transport of the sheet material in the same direction or further transport at a different angle.

Preferably, planes given by sheets in the removal positions enclose an angle greater than 0° with a horizontal plane, at least upon proper orientation of the apparatus or feed direction. The apparatus is for this purpose preferably so configured that planes given by sheets in the removal positions enclose an angle greater than 0° with a horizontal plane. The two planes or removal planes are thus preferably oriented at an angle to the horizontal, in particular vertically. This permits, on the one hand, a space-saving transport of the sheet material in vertical orientation, for example along a back wall of a bank-note processing apparatus. However, the vertical orientation is of special importance when the removal device is configured to be rigid and in particular has elements, for example removal rollers, which constantly protrude into the space defined between the two removal positions or removal planes. With two e.g. horizontally oriented removal planes there would otherwise be the danger of the fed sheet material already lying against the removal device due to gravity and being grasped and carried off by the removal device before being transported into one of the removal positions, for example pushed against a removal plane, by the distributing element, for example a slide.

Further, it is possible that the removal positions are spaced apart and define an interstice into which sheet material is transportable from the feed direction. In the method, the sheet material preferably upon delivery passes into an interstice which is defined by the spaced-apart removal positions. In this way a particularly compact structure can be obtained.

For exact feed, the apparatus can further have a guide device with at least one guide element before the distributing element or distributing elements in the feed direction, which is adapted to direct fed sheet material in the middle between the two removal positions or the two removal planes. The guide device can ensure that the fed sheet material is directed approximately in the middle between the two removal positions or removal planes and does not collide with the distributing element reciprocating between the two removal positions or removal planes, for example the slide, which is positioned, during the sheet-material feed, offset from the middle at least with an edge of the distributing element located in the direction of feed, and preferably lies against one of the removal planes.

The guide device, in particular the guide element, can form a transport gap for the fed sheet material. Said transport gap can in particular be limited in a simple manner by two plates located parallel to the sheet-material plane.

The distributing element can fundamentally be moved in any way, for which the apparatus can comprise a separate drive. In particular, the distributing element can be coupled with the drive. Upon use of more than one distributing element, a common drive or separate drives can be provided for the distributing elements. It is also possible, however, that the apparatus comprises at least one corresponding coupling element to an external drive. It is thus possible for example to rotate or swivel the distributing element or distributing elements relative to the feed direction upon the reciprocating motion of the distributing element or distributing elements. In the apparatus, the distributing element or distributing elements are then preferably adapted to swivel relative to the feed direction. Such a motion can be produced very easily.

However, it is also possible that upon the reciprocating motion of the distributing element or distributing elements, the distributing element or distributing elements are shifted relative to the feed direction. In the apparatus, the distributing element or distributing elements can then be shiftable relative to the feed direction. The distributing device can therefore have one or more displaceable slides as the distributing element or distributing elements for pushing fed sheet material alternatively into one of the removal positions or to one or the other of the two removal planes. In particular, the two removal planes can be spaced apart and define a space to which the sheet material to be diverted is fed and in which a slide is displaceable such that the sheet material fed between the two removal planes is pushed to one or the other of the two removal planes. When a fed sheet material is completely fed, it is pushed by means of the slide toward a removal plane so that it can be grasped by the removal device and carried off in the removal direction. However, the distributing elements, e.g. the displaceable slides, could fundamentally also be present outside the removal spaces and convey the sheet into one or the other removal plane from there.

It is also possible to combine the motion patterns.

The distributing element can be configured for example as a solid or interrupted plate or as a flat grid. In a particularly simple embodiment, however, the distributing element comprises a holder with at least two pockets for sheets of the sheet material which, for moving sheets into the removal positions, is reciprocated between end positions determining the removal positions, so that in each of the end positions a sheet passes into a different one of the pockets. In the apparatus, the distributing element is thus preferably a holder with at least two pockets for sheets of the sheet material which is adapted to be reciprocated between end positions determining the removal positions, so that in each of the end positions a different one of the pockets is located in a plane of the feed stream. While one sheet in one pocket passes into the removal position, a further sheet can thus be transported into the other pocket. Such a holder can largely define the removal position without further elements being necessary, so that a simple structure can be obtained. The holder can have for example solidly plate-shaped or interruptedly plate-shaped walls, or be formed of grid-shaped material. The holder preferably has further openings through which the sheet material located in the pockets can be carried off out of the pockets in the corresponding removal directions.

To permit simple carrying off or removal, the holder preferably has openings through which, upon reaching the end positions, at least one element of the removal device can engage for carrying off the sheets or sheet material in the pockets.

The removal positions can be defined by different elements of the apparatus depending on the embodiment. The removal positions can in particular depend on the arrangement and configuration of the removal device, since the latter must be able to carry off the sheet material out of the removal positions. To obtain a reliable positioning in the removal position, a contact element can be provided against which the sheet material is pushed for carrying off. The contact element then defines a contact surface which can be in particular a plane and at least partly defines the removal position. Contact elements defining a plane as a contact surface are also sometimes referred to as contact planes in the context of the invention. In a preferred embodiment of the apparatus, the removal positions can in particular be determined by a first removal plane and a second removal plane which are spaced apart and define the abovementioned interstice into which sheet material is feedable from the feed direction. In the apparatus, the removal device can then be adapted to carry off in at least one removal direction sheet material fed between the two removal planes.

The removal position can further also be determined by the distributing element which moves the sheet material into the removal position. In particular, this can be the case for example in the abovementioned embodiment in which the distributing element is given by the holder. A further, in particular stationary, contact element is then unnecessary.

It may fundamentally suffice to secure the removal positions physically only in directions that are not located in the feed direction. However, this necessitates a very exact time coordination between motion into the removal position and the actual removal. According to one embodiment, it is therefore preferred that the motion of the sheets in the feed direction is stopped in at least one of the removal positions, or fed sheet material is stopped. The apparatus then preferably has for this purpose a stopping device preferably disposed between the removal positions or removal planes for stopping a motion of the sheets in the feed direction. Motions in a direction orthogonal to the feed direction do not necessarily have to be stopped. Stopping seems to be important in particular in the case of inclined or vertically oriented removal planes.

Stopping can be effected in different ways. In a preferred embodiment, the sheets can be stopped using at least one stop. In the apparatus, the stopping device then preferably comprises a stop which is preferably disposed between the removal positions or removal planes for stopping sheet material fed from the feed direction in said direction. In this way it is possible to bring sheet material reliably into the removal positions even when it is delivered at high speed.

In general the stopping device can be configured on the distributing element and/or on contact elements which determine the removal position. For example, the distributing element can be configured in the form of a slide in the form of a reverse "T", in which case the short arms can preferably mesh with contact elements between which they are disposed. However, it is also possible to dispose the stopping element in stationary fashion. In particular, it can then preferably be connected to the contact elements, particularly preferably being configured integrally therewith.

Upon use of a stationary stop a particularly low-failure operation can be obtained if, in the apparatus, the distributing element meshes with the stop. In particular, a collision of the slide with the stop can be prevented.

In the embodiment of the apparatus in which the distributing element is given by the holder, the stop is preferably formed by at least one bottom portion of the holder. This results in a particularly simple structure of the apparatus.

The stopping device serves to stop the motion of the sheets in the feed direction. However, this is only understood to mean that the sheet material approximately comes to a standstill. It is still possible for it to bounce off the stop. To reduce such bouncing off, the stop can be formed of elastic material with a good damping effect, for example rubber or foam material. To hit the removal position as exactly as possible, however, it is preferred that for stopping the motion of the sheet material in the feed direction the motion of the sheets is braked parallel to the feed direction. In the apparatus, the stopping device for this purpose preferably comprises braking elements for braking the sheets at least after a collision with the stop. The braking elements, for example resilient tongues extending parallel to the feed direction, can be held on other parts of the apparatus, for example the distributing element or contact elements.

Depending on the requirements, it may be expedient for not all sheets to be diverted. It is therefore preferred that the distributing element is so configured and disposed that sheet material is distributable over the two removal positions and into a through opening in the stopping device. In the method, sheets can therefore alternatively be removed in the removal directions or be transported in a direction deviating from the removal directions and preferably matching the feed direction. This in particular permits the apparatuses to be operated in series, the transfer opening determining the feed direction for the following apparatus.

For removing or carrying off the sheets it is possible to use different variants alone or in combination. Even though the term "pull-off" is used for "carry off" in the context of the invention, this does not mean that a pull has to be exerted on the sheets. The term instead includes for example the possibility of the sheets being pushed or urged out of the removal position for being carried off.

The removal device itself can—but need not necessarily—be rigidly configured.

Further, the removal device can be disposed in stationary fashion relative to the feed direction and removal direction, at least with its elements acting directly on the sheets, i.e. moving the sheets. As soon as a sheet has reached the corresponding removal position, it can then be carried off by the removal device. It is also possible, however, that at least the elements of the removal device acting directly on the sheets are adapted to reciprocate toward the removal position at least in a direction transverse to the corresponding removal direction.

The elements acting directly on the sheets can in this connection be moved toward the removal positions from a direction that is contrary to the motion of the distributing element, whereby it does not need to extend parallel thereto. It is also possible, however, that at least one element of the removal device acting directly on the sheets is held on the distributing element or at least one of the distributing elements. In particular, the removal rollers can be integrated into the slide. The apparatus then preferably has contact elements against which the distributing element or the at least one element held thereon can press a sheet to be removed for being carried off. The removal device can then be controlled, for example by a purely mechanical or also electric removal control device, in coupling to the motion of the distributing element in such a way that the removal device is changed, for example by selection of the direction of rotation of the removal rollers, depending on whether the fed sheet material is pushed by means of the distributor element, for example the slide, into the first or second removal position, for example against the first or against the opposite second removal plane. If the sheets are to be carried off out of the two carry-off positions in different carry-off positions, however, it is only necessary to provide one element acting directly on the sheets, for example a belt drive.

According to a preferred embodiment, the sheets are removed or carried off out of the removal positions using moving friction elements which, during the carrying off, are in contact with the particular sheet to be carried off. In the apparatus, the removal device thus preferably has driven friction elements for carrying off the sheet material by interaction therewith. Since in this embodiment a pressure force between friction element and sheet material is necessary for producing a frictional force on the sheet material, at least one of the friction elements and the sheet to be carried off are pressed against each other to produce the pressure force. For this purpose the removal device can be so configured that at least the friction elements are movable relative to the removal position at least in the direction of a sheet located in the removal position. The friction element then urges the sheet against the distributing element not, or not substantially, giving way to the pressure, which then has not only a distributing function but at the same time also a carrying-off function. Alternatively, the removal device can be so configured that at least one of the friction elements is held or mounted in stationary fashion, and the distributing element is so configured and disposed that it urges against the friction element the sheet to be carried off out of the removal position corresponding to the friction element. These two alternatives can also be combined, although this involves increased constructional effort.

In the apparatus, the friction elements can for this purpose preferably, at least for carrying off a sheet out of one of the removal positions, engage at least partly through contact elements determining the removal positions. This has the advantage that a large contact surface permitting a reliable carrying off is available.

The friction elements can be mounted in stationary fashion. Alternatively, however, the friction elements are movable in the apparatus between a rest position in which they do not touch sheets in the particular removal position, and a removal position in which they press against one of the sheets in the corresponding removal position.

The friction elements can be configured in different ways. One possibility is that the removal device comprises removal rollers or removal wheels. A removal roller or removal wheel is in particular also understood here to mean an element mounted rotatably around an axis and having for example a circular or polygonal cross section in a plane extending transversely to the axis. In particular, the distributing element, for example the slide, can then push the fed sheet material toward the friction elements, for example the removal rollers, until the friction exerted on the sheet material by the friction elements, for example the removal rollers (at least one of which must be provided per removal plane), is so great that the sheet material is grasped and transported further according to the direction of rotation of the removal rollers.

In particular, in the apparatus the removal rollers can protrude through the two removal planes into the interstice defined by the two removal planes. If the friction elements are to be movable relative to the removal position, the removal rollers are preferably movable into the interstice formed by the two removal planes at least partly in the radial direction through the two removal planes.

As a further possibility, the friction elements can comprise at least one belt, in particular a flat or round belt.

Alternatively, in the method, a blown air stream extending at least partly tangentially to at least one of the removal positions can be produced so that sheet material is carried off out of the removal position at least partly by the air stream. In the apparatus, the removal device for this purpose preferably comprises at least one trans-port element connected to a blown air supply and having a blow-out duct connected to the blown air supply, out of which a blown air stream extending at least partly tangentially to at least one of the removal positions flows upon supply of blown air. The transport elements used here are preferably air baffle plates having blown air bores suppliable with blown air and inclined toward the removal direction, which are so disposed as to give a thrust component in the removal direction to the sheet to be carried off out of the removal position adjacent to the air baffle plate. The term "air" also includes any other gases. The use of air baffle plates has the advantage that the force for carrying off can be distributed uniformly over the sheet. Furthermore, upon suitable execution of the bores and suitable velocities of flow of the blown air, it is possible to obtain the effect that the sheet to be transported is transported on an air cushion between sheet and air baffle plate, so that there is no friction of the sheet on a solid body. Further, the only part to be moved is a valve for controlling the blown air, which is optional, however. The use of such a transport element, in particular an air baffle plate, is advantageous in particular when it at the same time constitutes the distributing element.

In particular, it is preferable with respect to the carrying off out of the removal positions that when a sheet is carried off in at least one of the removal directions a force is exerted on the sheet in a direction that is inclined with respect to a removal guiding direction given by at least one removal guide element. The apparatus has for this purpose preferably for at least one of the removal positions a removal guide extending parallel to the removal direction for guiding the sheets upon removal, and the removal device is configured to exert on the sheet upon removal a force with a component in the direction of the removal guide. This has the advantage that when the sheets are carried off they can at the same time be oriented by the removal guide element. In particular, the rotation axes of rotatably mounted friction elements, the transport directions of belts or the blown air ducts can for this purpose be inclined accordingly.

The removal directions for the removal positions can extend differently. In a preferred embodiment, the removal directions can enclose an angle smaller than 10° and preferably extend parallel. The apparatus, in particular the removal device, is thus preferably so configured that the removal directions enclose an angle smaller than 10°. Such an orientation is advantageous in particular when the sheets are not to be turned over.

According to another preferred embodiment, the removal directions can enclose an angle between 170° and 180° and in particular extend anti-parallel. The apparatus and in particular the removal device are then thus preferably so configured that the removal directions enclose an angle between 170° and 180°. This embodiment is advantageous in particular when the sheets are to be distributed over different removal paths.

It is fundamentally unnecessary for the removal direction for a removal position to be changeable. However, the inventive transport apparatus permits a removal or further transport of the fed sheet material alternatively in two opposite directions, for example in a simple manner by reversing the direction of rotation of the aforementioned removal rollers. In the method, it is therefore possible in a preferred embodiment that a sheet is carried off out of at least one of the removal positions in dependence on a stipulation for the sheet in one of two removal directions stipulated for the removal position. For this purpose, a removal control device can firstly be provided for controlling the removal device, which controls the removal device in dependence on the stipulation so as to obtain the desired removal direction for the removal position. In the simplest case this necessitates only a reversal of the direction of rotation of a drive. Upon use of an air baffle plate, the latter can have blown air ducts with one portion thereof inclined in one removal direction and another portion thereof in another removal direction, the portions being suppliable with blown air separately from each other. By controlling the supply accordingly, it is then possible to obtain a reversal of motion.

Alternatively, the removal device can have, for removing sheets out of at least one of the removal positions, at least two portions for removing a sheet in one of the removal positions in two different removal directions. In this case, a removal control device need only control the corresponding portion of the removal device in order to obtain the removal direction corresponding to the portion.

The stipulation can be given for example by data formed by means of a suitable sensor, or a signal, which renders a property of the fed sheet, for example whether its upper side had a desired orientation relative to the transport path that fed the sheet.

It is fundamentally possible to operated the motion of the distributing element and the removal device independently of each other at corresponding speed once they have been synchronized. It is preferred, however, that the motion of the distributing element and the carrying off are controlled in dependence on each other. The apparatus has for this purpose further preferably a control device for controlling the work of the distributing device and the work of the removal device in dependence on each other. In particular, the motion of the removal rollers and the displacement of the slide can thus be coupled in the apparatus. In particular, the motion of the removal device elements moving the sheets, for example of the removal rollers, and the motion of the distributing element, for example the displacement of the slide, can thus preferably be so coupled in a suitable manner that the elements or removal rollers are displaced into the interstice between the removal positions or removal planes e.g. only when the distributing element, for example the slide, moves toward the elements, for example the removal rollers.

The control device can be given firstly, in particular when only one drive is used for moving the distributing element and for the carrying off, by corresponding mechanical coupling elements. Alternatively, it is possible to use separate drives, which are electrically controllable, for moving the distributing element and for the carrying off. In this, preferred, case the control device can be given in particular by an electronic circuit and particularly preferably have a microprocessor for control. The control device can be integrated with the removal control device, depending on the embodiment and if present.

In particular, the control device can have a sensor for detecting the reaching of a stipulated position in the feed direction and/or the stop of the motion of a sheet in one of the removal positions, and be configured to control the removal device such that a sheet is carried off upon reaching the particular removal position. As a sensor it is possible to use in particular a light barrier for ascertaining the reaching of the removal position or of the stop or the time of entry into the apparatus, from which the reaching of the removal position can be determined if the speed of transport is known.

Alternatively, it is preferred, in the method, that the sheets are carried off out of the removal positions at equal time intervals. In the apparatus, the control device and/or the removal device are thus preferably configured so that sheets are removed at stipulated equal time intervals. This embodiment permits the resulting stream of carried-off sheets to be evened out.

If the intention is not to change the transport direction of all sheets, it is pre-ferred that the at least one distributing element is so moved that in dependence on a distributing stipulation stipulated sheets are let through between the removal positions in the feed direction. In the apparatus, at least one path extending through between the removal planes is thus provided, and the distributing element or distributing elements are so configured and disposed that fed sheets are alternatively diverted into one of the removal positions or let through between the removal positions in the feed direction in dependence on a distributing stipulation. The stipulation can be given firstly solely by preselected sheets, for example every third one, not being diverted, independently of the properties of the sheets. Secondly, it is possible that a control device for controlling a drive for the distributing element or drives for the distributing elements lets through or diverts them into the removal positions in dependence on at least one detected property of the sheets.

Frequently, it is intended only to change the transport direction. It is then preferred that the carried-off sheets are merged into a stream of sheet material. The apparatus for this purpose preferably has a guiding device which merges sheets removed out of the removal positions in the particular removal position in a single stream.

During the work of the apparatus the speed of the feed of sheet material and of the carrying off of sheet material can be coordinated with each other according to the properties of the stream or streams of sheet material arising during the carrying off. It is thus possible in one embodiment to select the carry-off speed in dependence on the feed speed in such a way that when the removed sheets are merged into a stream the sheets are disposed in shingled fashion, i.e. so as to lie partly one above the other. The carry-off speed is preferably so selected, however, that the carried-off sheets are present in singled form in the stream after being merged thereinto. In the apparatus, the control device is thus preferably configured to control the removal device such that the carried-off sheets are present in singled form in the stream after being merged thereinto.

It is frequently desirable that the transport plane is the same before and after the diverting apparatus. This is possible in a simple manner by means of the inventive apparatus since for example the two removal planes are followed by appropriately formed guiding elements which reduce the space defined between the two removal planes to an output transport gap which is located in the desired transport plane for further transport of the sheet material.

Behind (in the removal direction) at least one element of the removal device acting directly on the sheets, for example the removal rollers or an air baffle plate, and the distributing element, for example the slide, further-transport elements, for example transport rollers or transport belts, can be provided for transporting further the sheet material carried off by the elements acting directly on the sheet material, for example the removal rollers.

Particularly preferably, the further-transport elements are integrated into the above-mentioned guiding elements. It is preferable to use transport rollers for this purpose since they can be integrated in a particularly simple manner into the aforementioned guiding elements forming the output transport gap.

BRIEF DESCRIPTION OF THE DRAWING

The invention will hereinafter be explained further by way of example with reference to the accompanying drawings. Therein are shown.

DETAILED DESCRIPTION OF PREFERRED EMBODIMENTS OF THE INVENTION

Figure 1:
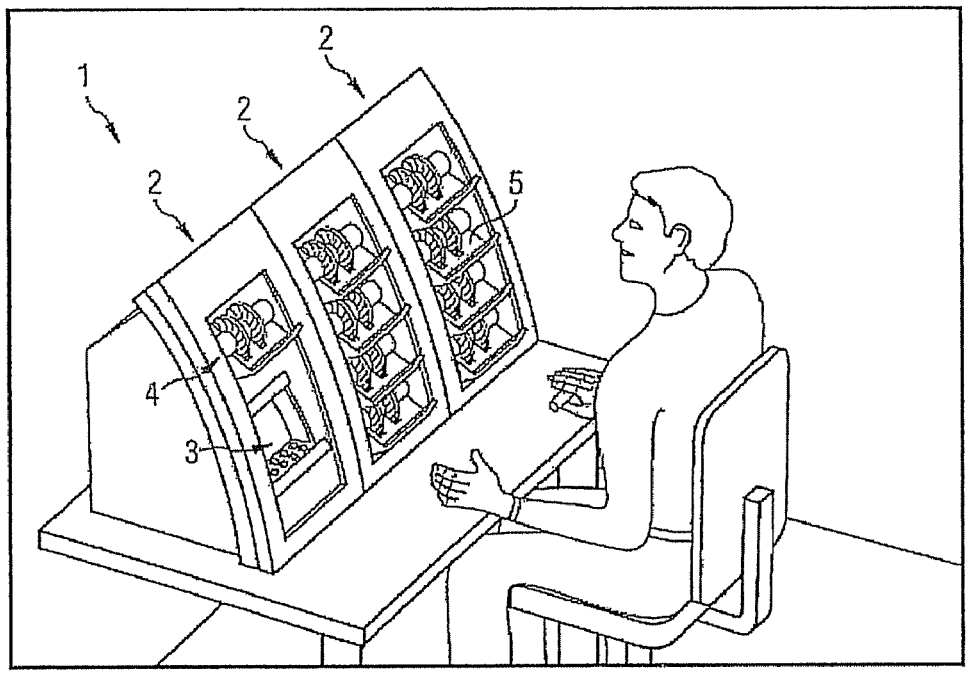
FIG. 1 a multimodular bank-note processing apparatus as a desktop model.

FIG. 1 shows a bank-note processing apparatus 1 as a concrete example of an apparatus for processing sheet-shaped value documents. The apparatus is of modular design and comprises three modules 2 in the shown exemplary embodiment. The left module comprises a sheet-material singler 3 with an input pocket into which an operator can insert sheet material, for example a bank-note stack or other value documents such as checks. The bank notes are drawn singly into the left module 2 by means of the singler 3 and checked and sorted by means of devices contained therein for measuring and checking sheet-material properties. This check can for example confine itself to the denomination of the inputted bank notes. Additionally or instead, it is also possible to check the quality and/or authenticity features of the bank notes. Bank notes that do not fulfill certain check criteria, because e.g. the denomination is not determinable and/or the result of the authentication check was negative and/or the fitness for circulation is no longer given, are outputted as so-called "rejects" in the reject pocket 4 disposed above the singler 3. The other documents are fed to a predetermined output pocket 5 according to the check result, so that they can be taken out of the output pockets 5 in appropriately sorted form by the operator.

In the shown exemplary embodiment, the two right modules 2 serve only to output the bank notes. Devices for measuring and checking the bank notes need not, but can, be contained here. All output pockets 4, 5 are executed as spiral slot stackers in the shown exemplary embodiment.

The bank notes are inputted, processed and outputted in transverse format in the bank-note processing apparatus 1. For transporting the bank notes from one module 2 to the next module 2 it is advantageous to use a transport apparatus as described hereinafter with reference to FIGS. 2 to 7. Such a transport apparatus 10 can be provided for example in the area of the rear side of a module 2 in vertical orientation in such a way that the bank notes BN transported in transverse format are fed to the transport apparatus 10 from a feed direction A vertically from above and carried off in a removal direction B at 90 degrees thereto, i.e. in the longitudinal direction of the bank notes BN. Such an arrangement is particularly space-saving. FIG. 7 shows besides the transport apparatus 10 purely by way of example a sensor 100 of the devices for measuring and checking sheet-material properties of the bank-note processing apparatus which checks bank notes in transverse transport. A first sheet-material transport path 101, which is provided by a per se known feeding transport device not specified in the figures, extends in the feed direction A and defines a feed plane which is given by the feed direction A and the plane of the fed sheets, in the example the bank notes BN. A second sheet-material transport path is given by a carry-off device 102 only symbolized by rollers, which defines the further-transport direction B and further-transport plane given by the plane of the transported bank notes, which in this example extends vertically like the feed plane.

Figure 2:
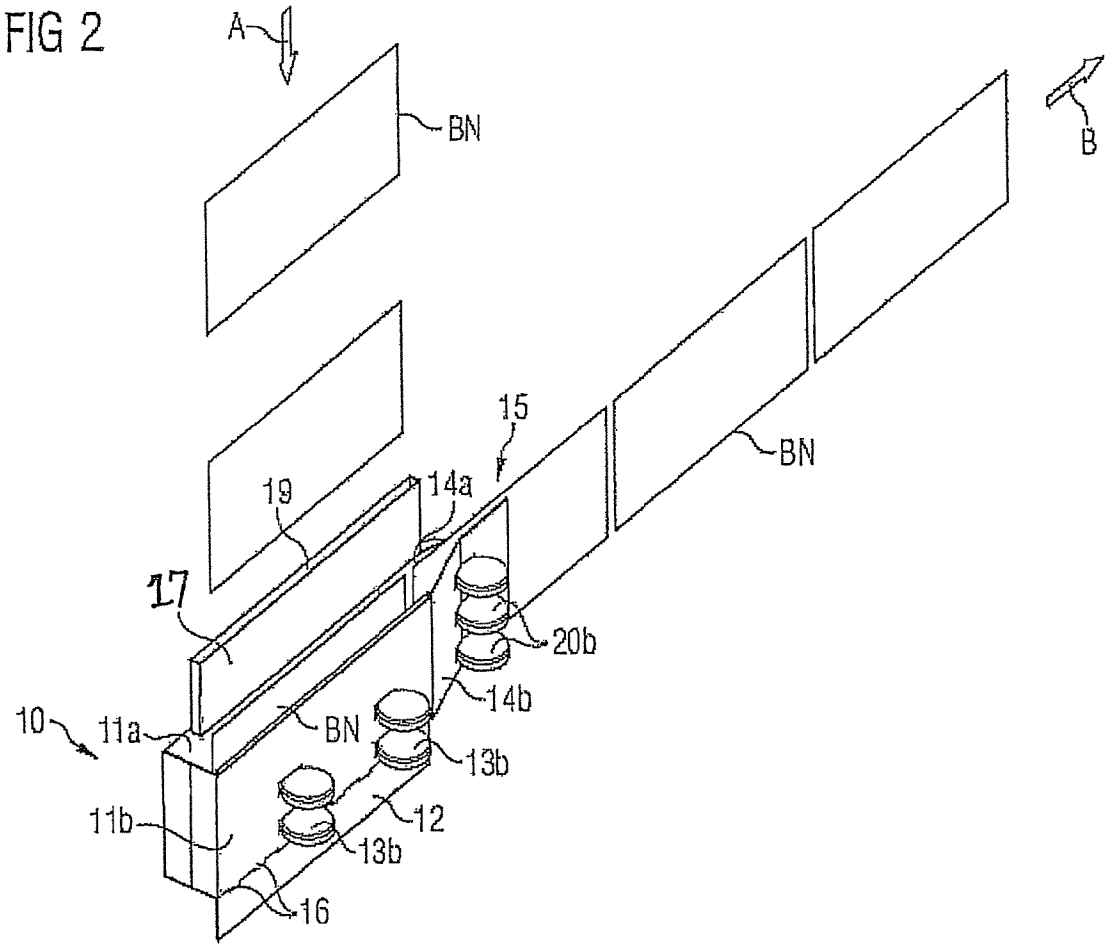
FIG. 2 a transport apparatus according to a first preferred embodiment of the present invention schematically in a perspective view, FIG. 3 the transport apparatus from FIG. 2 in a side view, FIG. 4 the transport apparatus from FIGS. 2 and 3 in a plan view, FIG. 5 a partial view of the transport apparatus from FIG. 2 in a first position, FIG. 6 a partial view of the apparatus from FIG. 2 in a different, second position, FIG. 7 a schematic partial view of the bank-note processing apparatus with the transport apparatus according to the first preferred embodiment of the invention in FIGS. 1 and 2, FIG. 8 a schematic partial view of a distributing element of a transport apparatus according to a second preferred embodiment of the invention, FIGS. 9 *a, b* schematic partial plan views of the transport apparatus according to the second preferred embodiment of the invention, wherein a distributing element is located in different end positions, FIG. 10 a schematic partial representation of a transport apparatus according to a third preferred embodiment of the invention, FIG. 11 a schematic partial representation of a removal device of a transport apparatus according to a fourth preferred embodiment of the invention, FIG. 12 a schematic partial representation of a transport device according to a fifth preferred embodiment of the invention, FIG. 13 a representation of a contact plate and a removal roller in a transport apparatus according to a sixth preferred embodiment of the invention, FIG. 14 a schematic partial representation of a transport device according to a sixth preferred embodiment of the invention, FIG. 15 a schematic partial representation of a transport device according to a seventh preferred embodiment of the invention, and FIG. 16 a schematic partial representation of a transport device according to an eighth preferred embodiment of the invention.
Figure 3:
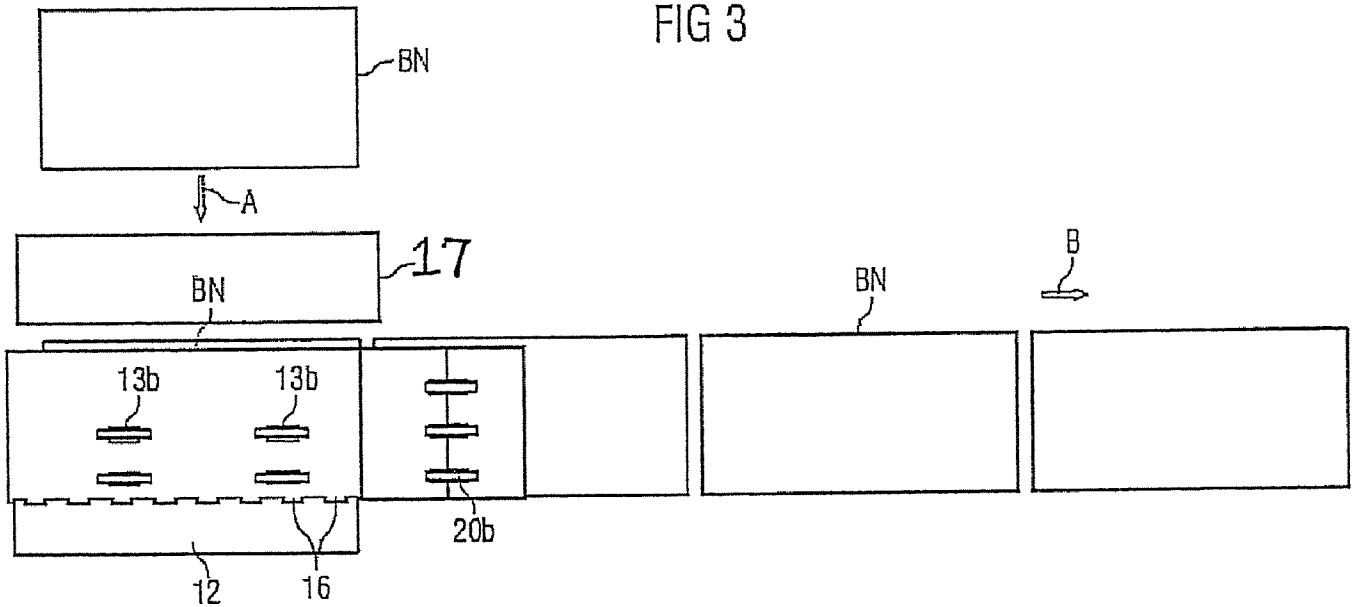

The transport apparatus 10 comprises contact elements or removal planes 11*a*, 11*b* determining two removal positions, which are configured in the shown exemplary embodiment as spaced-apart plates oriented parallel to each other and define corresponding removal positions. Furthermore, the transport apparatus 10 comprises a distributing element, in the example a slide 12, which is displaceable, in particular shiftable, between the two removal positions or removal planes 11*a*, 11*b* by a drive 103 and lies against the second removal plane 11*b* in the position shown in FIG. 2. The slide 12 serves, every time a bank note BN has been fed between the two removal planes 11*a*, 11*b*, to push the bank note alternatively to one or the other of the two removal planes 11*a*, 11*b*. In the case of FIG. 2 the bank note BN fed between the two removal planes 11*a*, 11*b* will be pushed by the slide 12 against the removal plane 11*a*.

Figure 4:
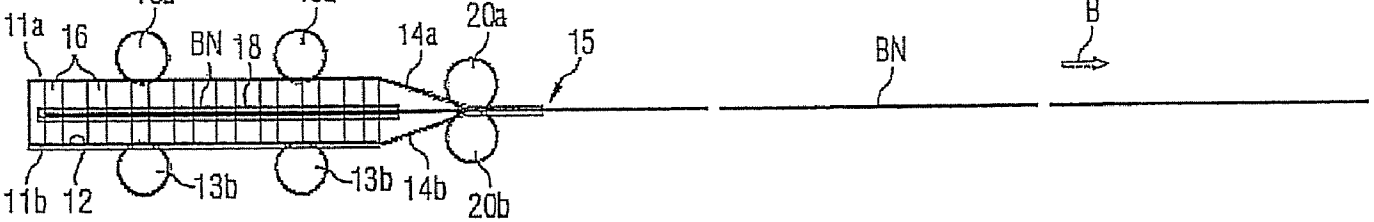
Figure 6:
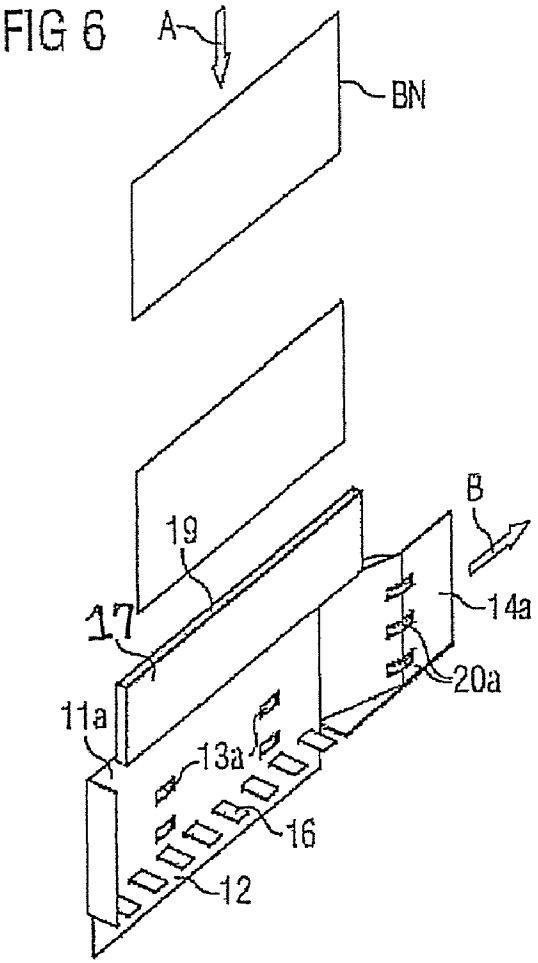
Figure 5:
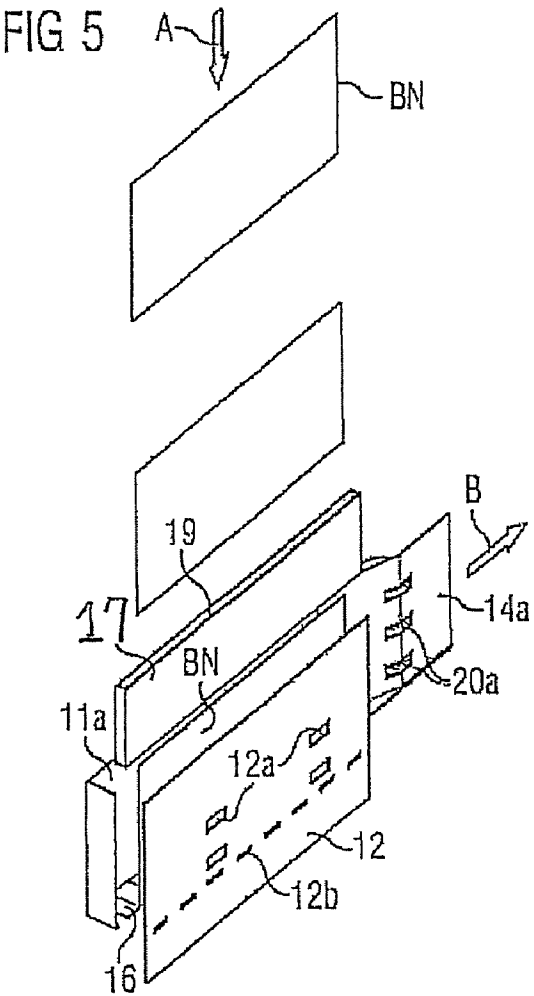

This can be recognized well from FIGS. 4 to 6. FIG. 4 shows the apparatus from FIG. 2 perpendicularly from above. The slide 12 lies against the removal plane 11*b*, and a bank note BN is located in the middle between the removal planes 11*a*, 11*b*. The bank note BN lies with its transverse edge on a stopping device, in this example a grid-shaped stop 16, which stops the motion of the bank note BN and simultaneously orients the bank note BN for further transport in removal direction B. An orientation at an angle deviating from 90 degrees is fundamentally also possible.

FIG. 5 shows this state in perspective, but without the plate forming the second removal plane 11*b*, so that the slide 12 is more clearly visible.

FIG. 6 shows the apparatus a short moment later after the slide 12 has been shifted against the first removal plane 11*a*, so that the bank note BN is now pinched between the slide 12 and the first removal plane 11*a*. For clarity's sake, however, the pinched bank note BN is not shown in FIG. 6.

The transport apparatus 10 further has a removal device 104 with two drives each associated with one of the removal positions or removal planes 11*a* and 11*b*, and carry-off elements acting directly on the sheets and driven by the corresponding drives. Of the drives and carry-off elements, the figures show only the drive 105 and the carry-off element 106.

In FIG. 6 there are visible through cut-out portions 12*a* in the distributing element or slide 12 the carry-off elements, in this embodiment removal rollers 13*a*, which act through the first removal plane 11*a* on the pinched bank note BN in such a way that the bank note BN is transported out of its pinched position in the removal direction B out of the transport apparatus 10. Corresponding removal rollers 13*b* are provided in the second removal plane 11*b* (FIGS. 1 to 4).

The rotation axes of the removal rollers 13*a*, 13*b* can be stationary. However, they can also be movable toward and away from the removal planes 11*a*, 11*b*, for which purpose a module of the drive 105 can be provided. This movability is preferably coordinated with the displacement of the slide 12 in such a way that either the removal rollers 13*a* or the removal rollers 13*b* protrude through the corresponding removal plane 11*a* or 11*b* into the interstice formed by the two removal planes 11*a*, 11*b* only when a fed bank note BN is pinched between the slide 12 and the corresponding removal plane 11*a* or 11*b* by means of the slide 12 for further transport in the removal direction B.

In FIG. 7 there is provided for this purpose a control apparatus 107 which is connected to the checking device 100 for receiving check signals and the drives 103 and 105 for control via corresponding signal connections. The control apparatus 107 controls in particular the removal device, more precisely, its modules of the drives for moving the carry-off elements or removal rollers, in dependence on the control of the slide 12, so that the described coupling is obtained in the above-described manner. In other exemplary embodiments a purely mechanical coupling can also be provided. The control device 107 is so configured in this exemplary embodiment that the stream of sheet material is present after the guiding elements as a stream of singled sheets. In another exemplary embodiment, the control could also be effected such that the sheet material is outputted in the form of a shingle stream.

The recesses or openings 12*a* of the slide 12 are provided in order to permit the slide 12, when removal rollers 13*a*, 13*b* are disposed in stationary fashion, to lie completely against one of the removal planes 11*a*, 11*b* during the feed of a bank note BN so that no gap remains into which the fed bank note BN could mistakenly slide. In the case of displaceable removal rollers 13*a*, 13*b* it is possible to omit the recesses 12*a*.

The slide 12 furthermore possesses recesses 12*b* which mesh with the grid-shaped stop 16. This ensures an exact orientation and reliable guide of the slide 12.

Before the slide 12 in the feed direction a guide element 17 is provided for directing the bank notes BN in the middle between the two removal planes 11*a*, 11*b*. The guide element defines a transport gap 19 for the bank notes BN and is limited by two plates located parallel to the sheet-material plane. This ensures that the fed bank notes BN do not collide with the slide 12 which preferably lies directly against one of the two removal planes 11*a*, 11*b* during the feed.

The removal planes 11*a* and 11*b* or the corresponding removal positions thus have removal directions $B_1$ and $B_2$ associated therewith which extend equidirectionally and parallel to each other. Guide elements 14*a*, 14*b* are shaped as a prolongation of the plates forming the removal planes 11*a*, 11*b* in such a way as to form an output gap 15. The output gap 15 defines a transport plane for the removal direction B of the bank notes BN which coincides with, but could also be different from, the transport plane of the feed direction A of the bank notes BN. Transport rollers 20*a*, 20*b* are integrated into the guide elements 14*a* or 14*b* on each side of the transport plane in order to transport the bank notes removed by means of the removal rollers 13*a*, 13*b* further in removal direction B.

FIG. 8 and FIGS. 9*a* and 9*b* partly show a transport apparatus according to a second preferred embodiment of the invention wherein the distributing element provided is now a holder 108 instead of the slide 12. The contact elements 11*a* and 11*b* are omitted. All other parts of the apparatus are unchanged compared to the first exemplary embodiment, so that the corresponding explanations apply here too and the same reference signs are used for the same parts.

The box-shaped holder 108 has two upwardly open pockets 109*a* and 109*b* which can each receive one sheet or bank note. The holder 108 has a bottom (not shown in the figures) which acts as a stopping device by stopping sheets or bank notes that collide with it. Further, there are configured in the walls of the holder 108 on longitudinal sides openings 110 for the removal rollers mounted in stationary fashion in this exemplary embodiment. The apparatus works in such a way that the drive 103 reciprocates the holder 108 between two end positions. The end positions are selected so that in each of the end positions a different pocket is disposed in the fall direction under the transport gap 19, as can be seen in FIG. 9*a* and FIG. 9*b*. The different pocket is so disposed that the carry-off elements, in the example the removal rollers 13*a* and 13*b*, engage through the openings 110, and a sheet BN in the corresponding pocket is pinched between the middle wall 111 and the carry-off elements, so that it can be carried off or removed through corresponding slots 111*a* and 111*b* in the end walls of the holder 108.

A transport apparatus according to a third preferred embodiment of the invention differs from the first exemplary embodiment in that the distributing element provided is now a plate 113 adapted to be swiveled back and forth between two positions by a drive 112 corresponding to the drive 103, and the contact elements 114*a* and 114*b* defining the removal positions are configured each in an L shape and tilted to each other at a stipulated angle. The guide elements 14*a* and 14*b* are configured so as to merge the sheets from the two removal directions $B_1$ and $B_2$ in the plane given by the second sheet-material transport path, so that they can be carried off in the direction B. All other parts of the apparatus are unchanged compared to the first exemplary embodiment, so that the corresponding explanations apply here too and the same reference signs are used for the same parts.

The short arms of the contact elements 114*a* and 114*b* serve as a stop for stopping the sheets or bank notes in the feed direction. The angle between the stop elements and the position of the distributing element 112 are so coordinated with each other that in the end positions (cf. FIG. 10) a sheet BN can be pinched between the distributing element 113 and the contact element 114*a* or 114*b*, the corresponding surfaces preferably extending at least approximately parallel.

A transport apparatus according to a fifth preferred embodiment of the invention differs from the first exemplary embodiment in that a different removal device and, associated therewith, different contact elements are used. All other parts of the apparatus are unchanged compared to the first exemplary embodiment, so that the corresponding explanations apply here too and the same reference signs are used for the same parts.

The contact elements 13*a* and 13*b* are now replaced by air baffle plates 115 of the removal device, of which one is shown in cross section in FIG. 11. The air baffle plate 115 has blow-out or blown air ducts 116 which are so disposed that sheets lying against it, upon supply of a blown air stream of suitable strength, are transportable suspended on an air cushion in the direction determined by the inclination of the blown air ducts 116 relative to the surface of the air baffle plate 115, i.e. the removal direction.

The removal device further has a blown air source 117 which is connected to the air baffle plates 115 via corresponding supply lines. In each of the supply lines there are disposed fast-response valves 118 connected to the control device 107 via signal lines and controllable electrically thereby, more precisely by a removal control device formed by the control device 107, said valves being used to switch on and off the blown air stream through the blown air openings 116.

Figure 13:
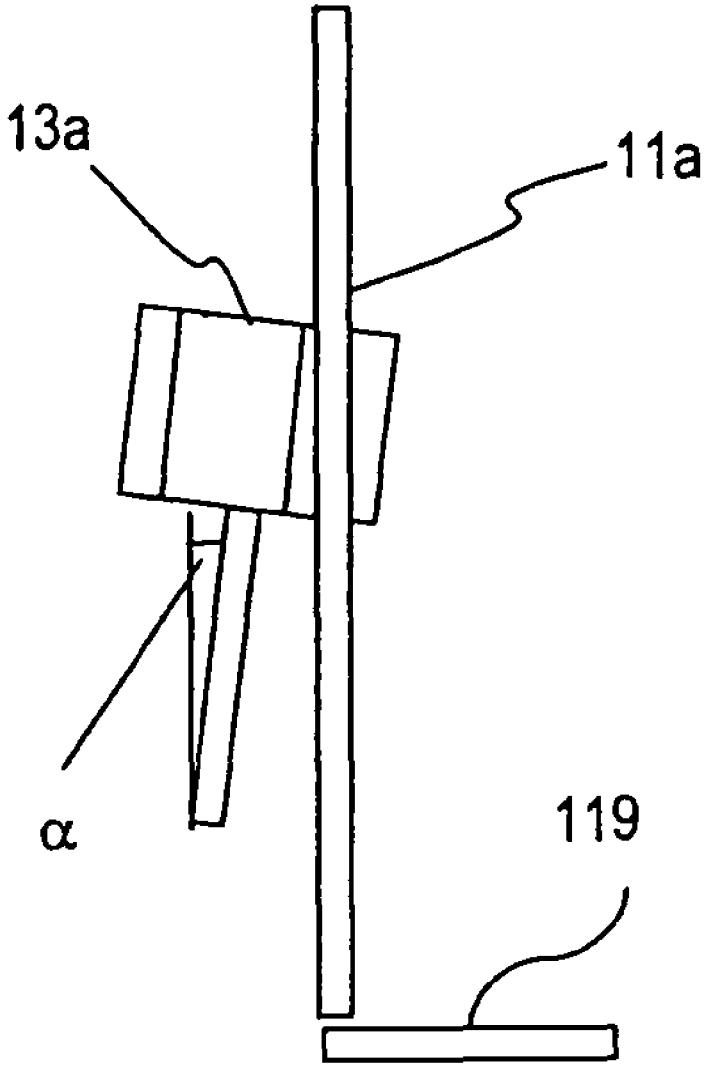

A transport apparatus according to a sixth preferred embodiment of the invention differs from the first exemplary embodiment only in that the removal rollers 13*a* and 13*b* are now inclined by an angle $\alpha$ relative to the contact elements 13*a* or 13*b* (cf. FIG. 13), and removal guide elements 119 extending in removal directions $B_1$ and $B_2$ are disposed after the contact elements 13*a* and 13*b* in the removal direction. Further, the cross section of the removal rollers is not circular but has the form of a polygon, in the example a hexagon. All other parts of the apparatus are unchanged compared to the first exemplary embodiment, so that the corresponding explanations apply here too and the same reference signs are used for the same parts.

The inclination of the removal rollers causes a component force pointing in the direction of the removal guide element 119 to be exerted on the sheets upon removal or carrying-off of the sheets, thereby driving them against the removal guide element 119. Since the removal roller has the polygonal cross section, corresponding component forces do not occur constantly but at intervals, in case of a suitable arrangement of the axes, so that the sheets can be simply oriented by the removal guide. The transport apparatus therefore additionally has an orienting function.

Figure 14:
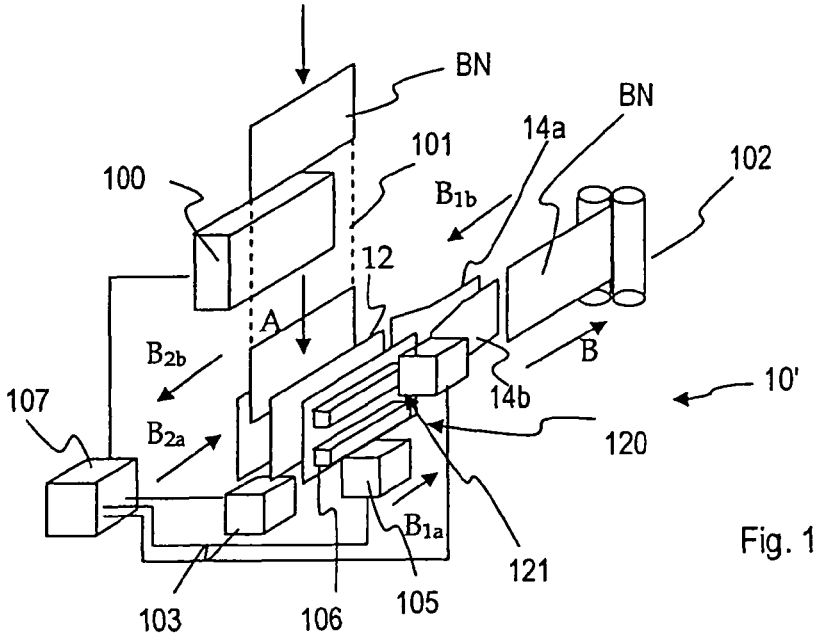

A transport apparatus 10' according to a seventh preferred embodiment of the invention differs from the first exemplary embodiment only in that for the removal positions given by the removal planes 13*a* and 13*b* two portions controllable separately from each other are now provided in each case, of which only the portions 120 and 121 are shown in FIG. 14 and which are each configured like the corresponding portion of the removal device in the first exemplary embodiment. Further, the control device 122 is modified compared to the first exemplary embodiment insofar as it controls the removal device in dependence on signals from the checking device or the sensor 100. Further, guide elements are provided symmetrically for opposite removal directions. All other parts of the apparatus are unchanged compared to the first exemplary embodiment, so that the corresponding explanations apply here too and the same reference signs are used for the same parts.

The control device 122 is more precisely so configured as to activate one of the two portions 120 and 121 in dependence on the check signals, the portion 120 being controlled for removal in the direction $B_{1a}$ and the portion 121 for removal in the direction $B_{1b}$. The same applies to the two other portions associated with the second removal position.

It is therefore possible to remove sheets in one or the other direction depending on a property ascertained upon the check.

Figure 15:
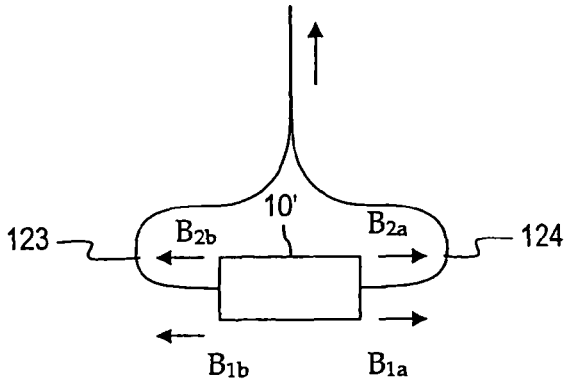

An example of application is shown in FIG. 15. Therein, behind the transport apparatus, there are disposed two further-transport paths 123 and 124 which proceed in opposite directions $B_{2a}$ and $B_{2b}$ from the transport apparatus marked by a rectangle, more precisely from the guide elements therein. The further-transport paths 123 and 124 converge into a second transport path. The further-transport paths 123 and 124 are selected to be equally long, so streams of sheet material outputted by the transport device can be merged with an exact time match.

The control device 122 is so configured as to ascertain the orientation of a sheet relative to the transport path, i.e. the upper side or underside of the sheet facing the upper side of the transport path, on the basis of the signals from the checking device or the sensor 100. It then controls the removal device such that sheets of the same orientation are removed in the same removal directions. This causes the sheets in the resulting stream of sheet material to all have the same orientation after the merge.

Figure 16:
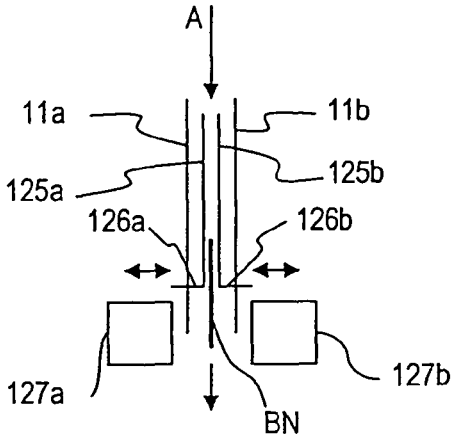

A transport apparatus according to an eighth preferred embodiment of the invention in FIG. 16 differs from the first exemplary embodiment firstly in the function and accordingly the configuration of the control device and secondly in that two distributing elements 125*a* and 125*b*, in the example in the form of a slide, are now provided which have stopping elements 126*a* and 126*b* in the form of a stop.

The L-shaped slides 125*a* and 125*b* are adapted to be reciprocated singly, upon corresponding control by the control device, between now three positions in a direction transverse to the feed direction A by drives 127*a* and 127*b*. To permit this, the stopping elements 126*a* and 126*b* mesh with the contact elements 11*a* and 11*b*.

The control device is configured to control the drives 127*a* and 127*b* in this exemplary embodiment in dependence on signals from the sensor 100 such that the following functions are obtained.

In the first two positions the two distributing elements 125*a* and 125*b* are moved in synchronism, whereby they lie against each other with their arms extending parallel to the feed direction A, so that the same function as in the first exemplary embodiment is obtained. The stop is now integrated into the distributing elements, however.

In the third position, which is illustrated in FIG. 16, the two distributing elements 153*a* and 125*b* are moved apart such that a sheet BN can be transported, or fall, through between them without diversion.

This permits use of the apparatus also for sorting purposes. Further, it is thus possible to dispose two transport apparatuses of the same type in tandem.

A transport apparatus according to a further preferred embodiment of the invention is modified compared to the first exemplary embodiment only with regard to the control device. In the first exemplary embodiment, the control of the removal device is effected in dependence on a detected time at which a stipulated part of a fed sheet has passed a stipulated place. The distributing element is moved in dependence on said time.

More precisely, the control device can have a sensor not shown the figures, in the example a light barrier, for detecting the reaching of a stipulated position in the feed direction and/or the stop of the motion of a sheet in one of the removal positions. The sensor can be disposed for example immediately behind the end of the transport gap 19. The control device is preferably configured to control the removal device such that a sheet is carried off when the particular removal position is reached.

In this exemplary embodiment, in contrast, the sheets are carried off out of the removal positions at equal time intervals, for which purpose the control device is accordingly configured. This permits the stream of sheet material to be evened out in the sense that the sheets show no, or in any case very small, fluctuations of the interval after the change of transport direction, even if there are fluctuations in the temporal or spatial interval upon the feed.

The apparatus for processing value documents, in particular bank notes, as is shown in FIG. 1 is to be understood as exemplary. It is possible for fewer or more modules to be provided and the arrangement of the modules relative to each other to be different. For example, there can be provided modules for outputting the value documents on the right and left of the apparatus module 2 having the sheet-material singler 3. In this case it is expedient to modify the transport apparatus 10 such that the bank notes BN fed to the transport apparatus 10 can be carried off alternatively in opposite removal directions B. For this purpose it is merely necessary to change the direction of rotation of the removal rollers 13*a* as required. Furthermore, the apparatus modules can possess more or fewer than the four output pockets 5 shown in each case. In particular, there can be two or more output pockets 5 provided above the input pocket of the singler 3 and/or also under the input pocket.

Figure 12:
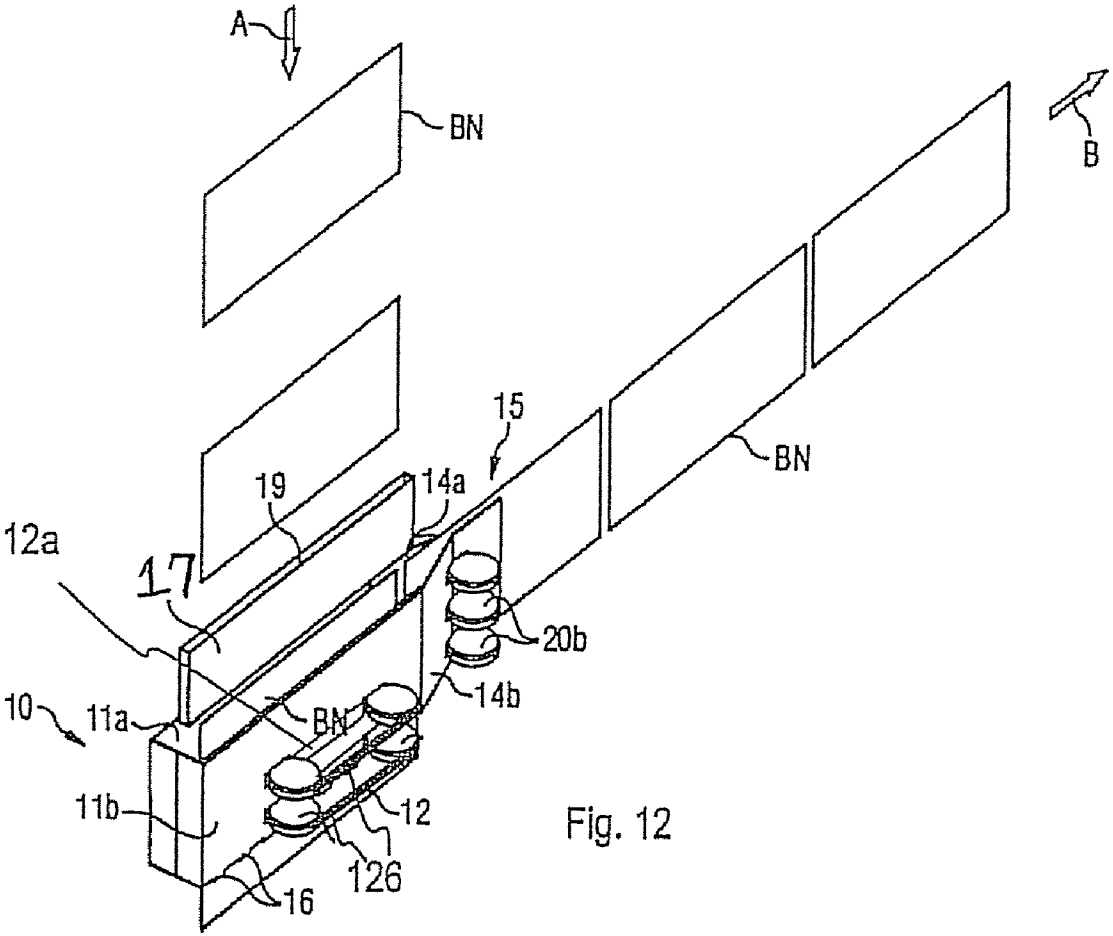

Deviating from the previously described exemplary embodiments, it is also possible to replace the removal and/or transport rollers 13*a*, 13*b*, 20*a*, 20*b* by transport belts 128, as illustrated in FIG. 12. For this purpose the recesses or openings 12*a* in the contact elements 11*a* and 11*b* are accordingly extended into one recess in each case. The corresponding sixth embodiment of the transport apparatus otherwise does not differ from that of the first exemplary embodiment.

Furthermore, the removal rollers 13*a*, 13*b* can be part of the displaceable slide 12 or be held thereon, and for example penetrate it in such a way that a part of the removal roller circumference protrudes on both sides of the slide 12.

Depending on which removal plane 11*a* or 11*b* the fed bank note BN is to be carried off from, the direction of rotation of the removal rollers integrated into the slide 12 should be changed.

In all described embodiments there can be braking elements provided on the contact elements and/or the distributing element or the pockets of the inside walls of the holder for braking at least the component of the motion of the sheets parallel to the feed direction A. There may for example be attached above the upper openings in the contact elements 11*a* and 11*b* or the openings 110 in the holder 108 resilient tongues, made for example of metal, which in their rest position protrude in the direction of the distributing element 12 or the inside wall 111 in the feed direction, but upon feed of a sheet are urged against the corresponding element into a braking position.

Although the invention is described in detail in connection with a bank-note processing apparatus, it is suitable accordingly for processing any sheet-shaped value documents. In particular, it need not necessarily serve to divert the value documents. A linear further transport, optionally also in different planes, is also possible with the inventive transport apparatus.

Further, the exemplary embodiments can also be combined with each other. For example, it is possible to use a removal device with two or four portions upon use of a distributing element in the form of a holder.

Further, two slides can also be used instead of the one slide 12 in the first exemplary embodiment.

Further combinations are possible.

The invention claimed is:

1. A transport apparatus for transporting flat, rectangular sheet material, wherein the sheet material are sheet-shaped value documents, comprising at least one distributing element reciprocating between at least two positions, said at least one distributing element pushing sheets of the sheet material delivered in a feed direction alternatively or alternatingly into at least two removal positions, and at least one removal device for carrying off the sheets out of the at least two removal positions in removal directions associated with the at least two removal positions, wherein at least one of the removal directions and the feed direction are different, the at least two removal positions are spaced apart and define an interstice into which the sheet material is transported from the feed direction, and at least a section of the at least one distributing element moves in the interstice between the at least two removal positions to push the sheet material.

2. The apparatus according to claim 1, which is so configured that at least one of the removal directions extends at an angle of 90° to the feed direction.

3. The apparatus according to claim 1, which is so configured that planes defined by sheets in the at least two removal positions enclose an angle greater than 0° relative to a horizontal plane.

4. The apparatus according to claim 3, wherein the at least two removal positions are followed by guide elements which form an output transport gap.

5. The apparatus according to claim 1, including a guide device with at least one guide element before the at least one distributing element in the feed direction, the at least one guide element being adapted to direct fed sheet material in the middle between the at least two removal positions.

6. The apparatus according to claim 1, wherein the at least one distributing element is adapted to swivel relative to the feed direction.

7. The apparatus according to claim 1, wherein the at least one distributing element is shiftable relative to the feed direction.

8. The apparatus according to claim 1, wherein the at least one distributing element comprises a holder with at least two pockets for sheets of the sheet material which is adapted to reciprocate between end positions determining the at least two removal positions, so that in each of the end positions a different one of the pockets is located in a plane defined by the sheets delivered in the feed direction.

9. The apparatus according to claim 8, wherein the holder has openings through which in each case upon reaching of the end positions at least one element of the at least one removal device can engage for carrying off the sheets.

10. The apparatus according to claim 1, wherein the at least two removal positions are determined by a first removal plane and a second removal plane which are spaced apart and define the interstice into which sheet material is feedable from the feed direction.

11. The apparatus according to claim 1, including a stopping device arranged to stop a motion of the sheets in the feed direction.

12. The apparatus according to claim 11, wherein the stopping device comprises a stop which is arranged to stop sheet material fed from the feed direction in said direction.

13. The apparatus according to claim 12, wherein the stopping device comprises braking elements for braking the sheets at least after a collision with the stop.

14. The apparatus according to claim 1, wherein the at least one removal device has driven friction elements for carrying off the sheet material.

15. The apparatus according to claim 14, wherein the friction elements engage at least partly through contact elements determining the at least two removal positions, at least for removal out of one of the at least two removal positions.

16. The apparatus according to claim 14, wherein the friction elements are movable between a rest position and a carrying off position, wherein in the rest position of the friction elements, the friction elements do not touch sheets in the at least two removal positions, and in the carrying off position of the friction elements, the friction elements press against one of the sheets in one of the at least two removal positions.

17. The apparatus according to claim 1, wherein the at least one removal device comprises removal rollers or belts.

18. The apparatus according to claim 1, wherein the at least one removal device comprises at least one transport element connected to a blown air supply and having a blow-out duct connected to the blown air supply, out of which a blown air stream extending at least partly tangentially to at least one of the at least two removal positions flows upon supply of blown air.

19. The apparatus according to claim 1, including, for at least one of the at least two removal positions, a removal guide extending parallel to the removal direction for guiding the sheets upon removal, and wherein the at least one removal device is configured to exert on the sheet upon removal a force with a component in a direction defined by the removal guide.

20. The apparatus according to claim 1, which is so configured that the removal directions enclose an angle smaller than 10° .

21. The apparatus according to claim 1, which is so configured that the removal directions enclose an angle between 170° and 180° .

22. The apparatus according to claim 1, wherein the at least one removal device has, for removal of sheets out of at least one of the at least two removal positions, at least two portions arranged to remove the sheet material in one of the at least two removal positions in two different removal directions.

23. The apparatus according to claim 1, including a control device arranged to control at least one drive for the at least one distributing element and the at least one removal device dependent on each other.

24. The apparatus according to claim 23, wherein the control device has a sensor for detecting at least one of reaching of a stipulated position in the feed direction or stopping of a motion of a sheet in one of the at least two removal positions, and is configured to control the at least one removal device such that sheet material is carried off when the sheet material reaches one of the at least two removal positions.

25. The apparatus according to claim 23, wherein at least one of the control device and the at least one removal device is configured so that sheets are carried off at stipulated equal time intervals.

26. The apparatus according to claim 1, wherein the at least one removal device comprises at least one element of the at least one removal device acting directly on the sheet material to move the sheet material out of one of the at least two removal positions along the associated removal direction, the apparatus further comprises further-transport elements behind the at least one element of the at least one removal device, and the at least one distributing element for further transporting the sheet material carried off by the at least one element acting directly on the sheet material.

27. The apparatus according to claim 26, wherein the at least two removal positions are followed by guide elements which form an output transport gap, and wherein the further-transport elements are integrated into the guide elements.

28. An apparatus for processing sheet-shaped value documents, comprising a first sheet-material transport path and a second sheet-material transport path, and a transport apparatus according to claim 1 between the first and second transport paths.

29. The apparatus according to claim 28, wherein the at least two removal positions of the transport apparatus are disposed at an angle to the horizontal.

30. The apparatus according to claim 29, wherein two removal planes defined by sheets in the at least two removal positions enclose an angle greater than 0° relative to a horizontal plane, and the two removal planes are oriented vertically.

31. The apparatus according to claim 28, including at least one device arranged to measure and check properties of the sheet material as well as at least one sheet-material input pocket with a sheet-material singler and at least one sheet-material output pocket.

32. The apparatus according to claim 28, including a plurality of apparatus modules, the transport apparatus being present between the first and second transport paths at a transfer point where sheet material is transported from one apparatus module to a following apparatus module.

33. The apparatus according to claim 32, wherein the sheet material has longitudinal and transverse orientations, and including an arrangement whereby the sheet material is transported in at least one first apparatus module in transverse orientation and is transported from said at least one first apparatus module to at least one second different apparatus module in longitudinal orientation.

34. A method for transporting flat, rectangular sheet material, wherein the sheet material are sheet-shaped value documents, comprising the steps:

delivering sheets of the sheet material in a feed direction in singled form;

reciprocating at least one distributing element between at least two positions;

said at least one distributing element pushing the sheets delivered in the feed direction alternatively or alternatingly into one of at least two removal positions; and the sheets are stopped in motion in the feed direction and are carried off out of the at least two removal positions in removal directions associated with the at least two removal positions, wherein the sheet material upon delivery passes into an interstice which is defined as the space between the at least two removal positions, and at least a section of the at least one distributing element moves in the interstice between the at least two removal positions to push the sheet material.

35. The method according to claim 34, wherein at least one of the removal directions and the feed direction are different.

36. The method according to claim 35, wherein the at least one of the removal directions extends at an angle of 90° to the feed direction.

37. The method according to claim 34, wherein planes defined by sheets in the at least two removal positions enclose an angle greater than 0° with a horizontal plane.

38. The method according to claim 34, wherein upon the reciprocating motion of the at least one distributing element, the at least one distributing element is rotated or swiveled relative to the feed direction.

39. The method according to claim 34, wherein upon the reciprocating motion of the at least one distributing element, the at least one distributing element is shifted relative to the feed direction.

40. The method according to claim 34, wherein the at least one distributing element comprises a holder with at least two pockets for sheets of the sheet material which, for moving sheets into the at least two removal positions, is reciprocated between end positions determining the at least two removal positions, so that in each of the end positions a sheet passes into a different one of the at least two pockets.

41. The method according to claim 34, wherein the motion of the sheets in the feed direction is stopped in at least one of the at least two removal positions.

42. The method according to claim 41, wherein the motion of the sheets in the feed direction is stopped in at least one of the at least two removal positions, and wherein for stopping the motion of the sheet material in the feed direction the motion of the sheets is braked parallel to the feed direction.

43. The method according to claim 34, including using at least one stop for stopping the value documents.

44. The method according to claim 34, wherein a blown air stream extending at least partly tangentially to at least one of the at least two removal positions is produced, so that sheet material is carried off out of the at least one of the at least two removal positions at least partly by the blown air stream.

45. The method according to claim 34, wherein upon carrying off of at least one sheet in at least one of the removal directions a force is exerted on the at least one sheet in a direction which is inclined relative to a guiding direction given by a removal guide element.

46. The method according to claim 34, wherein the removal directions enclose an angle smaller than 10° .

47. The method according to claim 34, wherein the removal directions enclose an angle between 170° and 180° .

48. The method according to claim 34, wherein at least one sheet is carried off out of at least one of the at least two removal positions, dependent on a stipulation for the sheet, in one of the removal directions stipulated for one of the at least two removal positions.

49. The method according to claim 34, wherein the sheets are carried off out of the at least two removal positions at equal time intervals.

50. A transport apparatus for transporting flat, rectangular sheet material, wherein the sheet material are sheet-shaped value documents, from a first sheet-material transport path to a second sheet-material transport path, comprising a first removal plane and a second removal plane which are spaced apart and define an interstice into which sheet material is fed from a feed direction, at least one displaceable slide arranged to push sheet material delivered in the feed direction alternatively to one or the other of the two removal planes by moving at least a section of the at least one displaceable slide in the interstice between the two removal planes, and a removal device which is adapted to carry off in at least one removal direction sheet material fed between the two removal planes.

51. The apparatus according to claim 50, which is so configured that the at least one removal direction and the feed direction are different.

52. The apparatus according to claim 51, which is so configured that the at least one removal direction extends at an angle of 90° to the feed direction.

53. The apparatus according to claim 50, wherein the two removal planes are followed by guide elements which form an output transport gap.

54. The apparatus according to claim 50, including a stop between the two removal planes arranged to stop sheet material fed from the feed direction.

55. The apparatus according to claim 54, wherein the at least one displaceable slide meshes with the stop.

56. The apparatus according to claim 50, including a guide element before the at least one displaceable slide in the feed direction, which is adapted to direct fed sheet material in the middle between the two removal planes.

57. The apparatus according to claim 56, wherein the guide element forms a transport gap for the fed sheet material.

58. The apparatus according to claim 57, wherein the transport gap is limited by two plates located parallel to a plane in which the sheet material is delivered.

59. The apparatus according to claim 50, wherein the removal device comprises removal rollers.

60. The apparatus according to claim 59, wherein the removal rollers protrude through the two removal planes into the interstice defined by the two removal planes.

61. The apparatus according to claim 60, wherein the removal rollers are movable through the two removal planes at least partly in a radial direction into the interstice formed by the two removal planes.

62. The apparatus according to claim 61, wherein the movability of the removal rollers and the displacement of the at least one displaceable slide are coupled.

63. The apparatus according to claim 59, including transport rollers or transport belts behind the removal rollers and the at least one displaceable slide for further transporting sheet material carried off by the removal rollers.

64. The apparatus according to claim 63, wherein the transport rollers or transport belts are integrated into guide elements.

* * * * *